US010597750B2

(12) United States Patent
Dimitrakis et al.

(10) Patent No.: US 10,597,750 B2
(45) Date of Patent: Mar. 24, 2020

(54) APPARATUS AND A METHOD FOR TREATMENT OF MINED MATERIAL WITH ELECTROMAGNETIC RADIATION

(71) Applicant: TECHNOLOGICAL RESOURCES PTY. LIMITED, Brisbane (AU)

(72) Inventors: Georgios Dimitrakis, Nottingham (GB); Samuel Kingman, Burton on Trent (GB); Christopher Dodds, Nottingham (GB); Andrew Batchelor, Nottingham (GB); Aled Jones, Nottingham (GB)

(73) Assignee: Technological Resources Pty. Limited, Melbourne, Victoria (AU)

( * ) Notice: Subject to any disclaimer, the term of this patent is extended or adjusted under 35 U.S.C. 154(b) by 803 days.

(21) Appl. No.: 14/439,861

(22) PCT Filed: Oct. 30, 2013

(86) PCT No.: PCT/AU2013/001257
§ 371 (c)(1),
(2) Date: Apr. 30, 2015

(87) PCT Pub. No.: WO2014/066941
PCT Pub. Date: May 8, 2014

(65) Prior Publication Data

US 2015/0292056 A1 Oct. 15, 2015

(30) Foreign Application Priority Data

Oct. 30, 2012 (AU) ..... 2012904769

(51) Int. Cl.
*H05B 6/64* (2006.01)
*C22B 1/24* (2006.01)
(Continued)

(52) U.S. Cl.
CPC ..... *C22B 1/24* (2013.01); *B02C 19/18* (2013.01); *C22B 1/00* (2013.01); *C22B 4/00* (2013.01);
(Continued)

(58) Field of Classification Search
CPC .... C22B 1/24; C22B 1/00; C22B 4/00; C22B 4/08; H05B 6/78; H05B 6/80; B02C 19/18
(Continued)

(56) References Cited

U.S. PATENT DOCUMENTS 2,953,708 A * 9/1960 Duncan ..... H01J 23/30 315/3.5
3,221,255 A * 11/1965 Rabowsky ..... H01P 1/39 333/1.1
(Continued)

FOREIGN PATENT DOCUMENTS

AU 2003214468 A1 10/2003
CL 1381-2011 8/2011
(Continued)

OTHER PUBLICATIONS

International Search Report dated Dec. 19, 2013 (PCT/AU2013/001257); ISA/AU.
(Continued)

*Primary Examiner* — Tu B Hoang
*Assistant Examiner* — Masahiko Muranami
(74) *Attorney, Agent, or Firm* — Banner & Witcoff, Ltd.

(57) ABSTRACT

The present disclosure provides an apparatus for treatment of mined material. The apparatus comprises a source for generating electromagnetic radiation and a microwave inlet region for exposing fragments of the mined material to the electromagnetic radiation. Further, the apparatus comprises a reflective structure adjacent the microwave inlet region
(Continued)

and providing, or surrounding, a passage for guiding the fragments of the mined material to the microwave inlet region. The reflective structure is arranged to attenuate penetration of the electromagnetic radiation from the microwave inlet region into the passage during throughput of the fragments of the mined material.

13 Claims, 14 Drawing Sheets

(51) Int. Cl.

| | |
|---|---|
| ***B02C 19/18*** | (2006.01) |
| ***H05B 6/80*** | (2006.01) |
| ***C22B 1/00*** | (2006.01) |
| ***C22B 4/00*** | (2006.01) |
| ***C22B 4/08*** | (2006.01) |
| ***H05B 6/78*** | (2006.01) |

(52) U.S. Cl.
CPC ..... *C22B 4/08* (2013.01); *H05B 6/78* (2013.01); *H05B 6/80* (2013.01)

(58) Field of Classification Search
USPC ..... 219/698, 687, 762, 629, 634, 635, 649, 219/654, 658, 666, 684, 728, 729, 741, 219/753, 388; 333/81 R, 81 A, 81 B, 12, 333/209, 232, 235, 208, 210, 211; 373/138, 142, 146, 150, 155, 161
See application file for complete search history.

(56) References Cited

U.S. PATENT DOCUMENTS 3,611,214 A * 10/1971 Gerlack ..... H01P 1/16 333/208
3,634,783 A * 1/1972 Rooney ..... H01P 1/264 333/22 R
3,940,718 A * 2/1976 Vilkaitis ..... H01P 3/14 333/241
5,331,284 A * 7/1994 Jean ..... G01N 22/04 324/636
5,400,004 A * 3/1995 Moeller ..... H01P 1/08 333/251
5,824,133 A * 10/1998 Tranquilla ..... C22B 1/00 219/693
5,869,816 A * 2/1999 Strack ..... F27B 9/142 219/687
6,066,290 A * 5/2000 Dennis ..... B22F 3/105 266/249
2009/0013822 A1* 1/2009 Shaw ..... C22B 1/00 75/10.13
2010/0163555 A1* 7/2010 Hallac ..... F27B 9/36 219/691
2010/0263482 A1 10/2010 Liubakka et al.
2012/0018550 A1 1/2012 Goodes et al.
2013/0305879 A1 11/2013 Regenfuss et al.

FOREIGN PATENT DOCUMENTS

| | | | |
|---|---|---|---|
| CL | 894-2013 | | 10/2013 |
| CN | 16922168 | A | 11/2005 |
| CN | 102569967 | A | 7/2012 |
| EP | 2385146 | A1 | 11/2011 |
| WO | 2012016286 | A1 | 2/2012 |

OTHER PUBLICATIONS

International Preliminary Report on Patentability (Chapter II) dated Feb. 18, 2015 (PCT/AU2013/001257); IPEA/AU.
Australian Patent Office International-Type Search Report dated Nov. 30, 2012 (2012904769 AU); ISA/AU.

* cited by examiner (a) (b)

APPARATUS AND A METHOD FOR TREATMENT OF MINED MATERIAL WITH ELECTROMAGNETIC RADIATION

CROSS-REFERENCE TO RELATED APPLICATIONS

The present application is a U.S. National Phase filing of International Application No. PCT/AU2013/001257, filed on Oct. 30, 2013, designating the United States of America and claiming priority to Australian Patent Application No. 2012904769 filed Oct. 30, 2012, and the present application claims priority to and the benefit of both the above-identified applications, which are incorporated by reference herein in their entireties.

FIELD OF THE INVENTION

The present invention relates to an apparatus and a method for treatment of mined material with electromagnetic radiation, and relates particularly, although not exclusively, to an apparatus and a method for treatment of mined materials with microwave radiation.

The term "mined" material is understood herein to include metalliferous material and non-metalliferous material. Iron-containing and copper-containing ores are examples of metalliferous material. Coal is an example of a non-metalliferous material. The term "mined" material is also understood herein to include (a) run-of-mine material and (b) run-of-mine material that has been subjected to at least primary crushing or similar size reduction after the material has been mined and prior to being sorted. Further, the term "mined" material includes mined material that is in stockpiles.

The present invention also relates to recovering valuable material from mined material and relates particularly, although not exclusively, to treating mined material at high throughputs.

BACKGROUND OF THE INVENTION

It has recently been proposed to treat mined material with high intensity microwave radiation to cause formation of cracks in fragments of mined material. The fragments may include gangue and valuable material (such as copper or iron containing minerals) and the exposure of the fragments to high power-density electric fields related to the high intensity microwave radiation causes preferential heating and resultant thermal expansion of some of the components of the fragments, which results in formation of micro-cracks and macro-cracks. Such cracks improve for example energy required to break the fragments apart and improve access for leach solutions. The formation of the cracks is directly related to the value and rate of development of a temperature differential that is created during the application of the high intensity microwave radiation.

SUMMARY OF THE INVENTION

The present invention provides in a first aspect an apparatus for treatment of mined material, the apparatus comprising:

- a source for generating electromagnetic radiation;
- a radiation inlet;
- a radiation inlet region at the radiation inlet and being arranged for exposing fragments of the mined material to the generated electromagnetic radiation;

- a passage portion for guiding the fragments of the mined material to the radiation inlet region; and
- a reflective structure providing, or surrounding, at least a portion of the passage, the reflective structure being arranged to attenuate penetration of the electromagnetic radiation from the radiation inlet region into the passage during throughput of the fragments of the mined material.

As propagation of the electromagnetic radiation from the radiation inlet region into the passage is reduced, embodiments of the present invention have the advantage that heating of the mined material within the passage is also reduced, which facilitates an effectiveness of the treatment of the fragments of the mined material with the electromagnetic radiation.

The reflective structure may comprise an inner conduit, such as an inner liner, that has at least a wall portion formed from a material that is substantially transparent for the electromagnetic radiation and that is positioned to provide the passage.

The radiation inlet region may comprise an inner conduit having at least a wall portion that is formed form a material that is substantially transparent for the electromagnetic radiation and is at least partially positioned at the radiation inlet.

In accordance with a second aspect of the present invention, there is provided an apparatus for treatment of mined material, the apparatus comprising:

- a source for generating electromagnetic radiation;
- a radiation inlet;
- a radiation inlet region at the radiation inlet and being arranged for exposing fragments of the mined material to the generated electromagnetic radiation;
- a passage for guiding the fragments of the mined material to the radiation inlet region; and
- a reflective structure positioned above the radiation inlet region and providing, or surrounding, at least a portion of the passage, the passage having diameter that is substantially uniform or changes uniformly along at least the majority of the length of the reflective structure, the reflective structure being arranged to attenuate penetration of the electromagnetic radiation from the radiation inlet region into the passage during throughput of the fragments of the mined material.

The reflective structure may comprise an inner conduit, such as an inner liner, that has at least a wall portion formed from a material that is substantially transparent for the electromagnetic radiation and that is positioned to provide the passage.

The radiation inlet region may comprise an inner conduit having at least a wall portion that is formed form a material that is substantially transparent for the electromagnetic radiation and is at least partially positioned at the radiation inlet.

In accordance with a third aspect of the present invention, there is provided an apparatus for treatment of mined material, the apparatus comprising:

- a source for generating electromagnetic radiation;
- a radiation inlet;
- a radiation inlet region at the radiation inlet and being arranged for exposing fragments of the mined material to the generated electromagnetic radiation;
- an inner conduit for guiding the fragments of the mined material through the radiation inlet region, the inner conduit comprising at least a wall portion that is formed from a material that is substantially transparent for the electromagnetic radiation and is positioned such that the generated electromagnetic radiation passes through the wall portion into the microwave inlet region;

a passage for guiding the fragments of the mined material to the radiation inlet region;

a reflective structure positioned above the radiation inlet region and providing, or surrounding, at least a part of the passage and being arranged to attenuate penetration of the electromagnetic radiation from the radiation inlet region into the passage during throughput of the fragments of the mined material.

The reflective structure may comprise an inner conduit, such as an inner liner, that has at least a wall portion formed from a material that is substantially transparent for the electromagnetic radiation and that is positioned to provide the passage.

In accordance with a fourth aspect of the present invention, there is provided an apparatus for treatment of mined material, the apparatus comprising:

a radiation inlet;

a radiation inlet region at the radiation inlet and being arranged for exposing fragments of the mined material to the generated electromagnetic radiation;

an inner conduit for guiding the fragments of the mined material through the radiation inlet region, the inner conduit comprising at least a wall portion that is formed from a material that is substantially transparent for the electromagnetic radiation and is positioned such that the generated electromagnetic radiation passes through the wall portion into the microwave inlet region;

a passage for guiding the fragments of the mined material to the radiation inlet region;

a reflective structure positioned above the radiation inlet region and providing, or surrounding, at least a part of the passage and being arranged to attenuate penetration of the electromagnetic radiation from the radiation inlet region into the passage during throughput of the fragments of the mined material.

The reflective structure may comprise an inner conduit, such as an inner liner, that has at least a wall portion formed from a material that is substantially transparent for the electromagnetic radiation and that is positioned to provide the passage.

The Following Relates to Features that the Apparatus in Accordance with the First, Second, Third or Fourth Aspect of the Present Invention May have.

The material that is substantially transparent for the electromagnetic radiation has a relative dielectric permittivity $\varepsilon^*=\varepsilon'-j\varepsilon''$ ($\varepsilon'$: real part of the relative dielectric permittivity; $\varepsilon''$: imaginary part of the relative dielectric permittivity) and wherein $\varepsilon''$ is less than 0.1, 0.05, 0.01, 0.005 or even 0.001. The real part $\varepsilon'$ may for example be in the range of 1-20 or 5-10.

The reflective structure may be positioned superjacent the microwave inlet region.

In one embodiment the reflective structure comprises a metallic tube that comprises the succession of first and second zones. The first zones may have an average inner diameter that is smaller than that of the second zones and may be arranged such that the tube has inner diameter that undulates in a direction along the tube such that the tube has a corrugated wall portion.

In another embodiment the reflective structure also comprises a succession of first zones and second zones, the first zones comprising a material that has a dielectric constant that is lower than that of the second zones. For example, the first zones may be metallic and the second zones may also comprise an insulating material. Further, the second zones may be partially provided in the form of air gaps or pockets. The first and second zones may have substantially the same inner diameter such that the succession of the first and second zones has a substantially uniform inner diameter.

The apparatus may be arranged for feeding with the fragments of the mined material by gravity. The passage may be a substantially vertical passage and may be a part of a substantially vertical conduit through at least a portion or the entire apparatus. The substantially vertical conduit may comprise the inner conduit of the reflective structure and the inner conduit of the radiation inlet region. The apparatus may be arranged for throughput of a packed bed of the fragments of the mined material by gravity.

The inner conduit of the reflective structure may have an inner diameter that is uniform along a length portion L of the inner conduit and wherein L is greater than a thickness of at least one of the zones.

Alternatively, the inner conduit of the reflective structure may have an inner diameter that changes linearly, uniformly or progressively along a length portion L of the inner conduit.

In one embodiment the reflective structure has an inner diameter that changes along at least a portion of the length of the reflective structure and wherein the inner conduit is positioned within at least the portion of that length of the reflective structure and is arranged to reduce a change in inner diameter of the reflective structure as otherwise in use experienced by the falling bed of particles of the mined material.

The reflective structure may be arranged such that an electric field intensity associated with the electromagnetic radiation decreases at a rate of at least 15, 20, 25, 30, 35, 40, 45 or 50 dB/m in a direction from the radiation inlet region into the passage. Further, the reflective structure may be arranged such that a power density associated with the electromagnetic radiation within the heated microwave absorbent phase of the fragments decreases at a rate of at least 30, 40, 50, 60, 70, 80, 90 or 100 dB/m in a direction form the cavity into the passage.

The source may be arranged to generate microwave radiation. The microwave radiation may have any suitable wavelength in the range of 300 MHz-300 GHz, 500 MHz-30 GHz or 600 MHz-3 GHz, for example 2450 MHz or 915 MHz.

In one embodiment the apparatus is arranged such that the microwave radiation causes heating of portions of at least some of the fragments of the mined material in the treatment region and an associated power-density in the heated fragments of the mined material is at least $1\times10^9$ W/cm$^3$, $1\times10^{10}$ W/cm$^3$, $1\times10^{11}$ W/cm$^3$ when the fragments of the mined material are put through the apparatus in the form of a packed bed.

The length of the reflective structure may be in the range of 500 mm-2000 mm, 700-1800 mm, 900-1600 or 1000-1400, such as of the order of 1200 mm.

The length of the reflective structure may be arranged such that microwave radiation propagating along a portion of the length will experience an environment in which dielectric properties change typically periodically. The succession of first and second zones and may be arranged such that microwave radiation, when passing into the reflective structure, experiences a dielectric environment in the first zones that is different to that in the second zones.

Each first zone of the reflective structure and typically also each second zone may have a ring or arc-like shape and may be oriented in a plane perpendicular to an axis of the conduit. The length of the reflective structure may comprise any number of alternating first and second zones, such as in the range of 1-50, 2-40, 3-30, 4-20 or 5-15 first zones and in the range of 1-50, 2-40, 3-30, 4-20 or 5-15 second zones.

The total height (in a direction along the passage to the radiation inlet region) of one of the first zones and an adjacent one of the second zones together may be in the range of 50%-90% or 60%-80%, such as of the order of 75% of the group wavelength of the microwaves that in use are generated by the source of the microwave radiation. Each first zone may have a height in the range of 20%-800, 30%-70% or 40%-60%, such as of the order of 25% or 50% of the group wavelength of the microwaves that in use are generated by the source of the microwave radiation. The heights of the first zones may not all be identical in order to broaden the wavelengths band within which the length of the conduit is arranged to reflect the microwave radiation. Further, the heights of the second zones typically are also not all identical.

The heights of the first and second zones and the materials of the first and second zones may be selected such that the length of the reflective structure is arranged to reflect microwave radiation within a wavelengths range that includes the wavelength or at least a portion of the wavelengths range that in use is generated by the source of the electromagnetic radiation.

In one embodiment the apparatus also comprises a further passage for guiding the fragments of the mined material away from the radiation inlet region. In this embodiment the apparatus may have a further reflective structure that is below and typically subjacent the radiation inlet region and may be of the above-described type. The further reflective structure may be arranged such that propagation of the electromagnetic radiation from the radiation inlet region into the further passage is reduced, which has the advantage that power consumption may be reduced. The further reflective structure may be arranged such that an electric field intensity associated with the electromagnetic radiation decreases at a rate of at least 15, 20, 25, 30, 35, 40, 45 or 50 dB/m in a direction from the radiation inlet region into the further passage. Further, the further reflective structure may be arranged such that a power density associated with the electromagnetic radiation within the heated microwave absorbent phase of the fragments decreases at a rate of at least 30, 40, 50, 60, 70, 80, 90 or 100 dB/m in a direction form the cavity into the further passage.

The apparatus may be arranged for a throughput of at least 100, 250, 500 or 1000 tonnes per hour.

The apparatus may also comprise a crusher for crushing and fragmenting the mined material prior to feeding the mined material into the conduit. The apparatus may further be arranged to process the treated fragments of the mined material after exposure to microwave treatment to recover valuable material.

In accordance with a fifth aspect of the present invention, there is provided a method of treating mined material, the method comprising the steps of:

providing a throughput of a packed bed of fragments of a mined material through an apparatus for treatment of the mined material; and generating microwave radiation and directing the microwave radiation to the throughput of the fragments of the mined material thereby exposing the throughput of the fragments of the mined material to the microwave radiation;

wherein the fragments of the mined material, when falling through the apparatus, are exposed to an increase in electric field intensity at a rate of at least 15 dB/m or an increase in power density within the heated microwave absorbent phase of the fragments at a rate of at least 30 dB/m along a path through the apparatus.

The rate at which the electric field intensity increases may be at least 20, 25, 30, 35, 40, 45 or 50 dB/m. The rate at which the power density increases within the heated microwave absorbent phase of the fragments may be at least 40, 50, 60, 70, 80, 90 or 100 dB/m.

The microwave radiation may have any suitable wavelength, such as a wavelength in the range of 300 MHz-300 GHz, 500 MHz-30 GHz or 600 MHz-3 GHz, for example 2450 MHz or 915 MHz. The method may be conducted such that the microwave radiation causes heating of the fragments of the mined material and an associated power-density in the fragments of the mined material of the packed bed is at least $1\times10^{9}$ W/cm$^3$, $1\times10^{10}$ W/cm$^3$, typically at least $1\times10^{11}$ W/cm$^3$.

The method may comprise gravity feeding the mined material such that a packed bed of the mined material passes through the apparatus.

Further, the method may comprise crushing the mined material prior to feeding mined material into the conduit.

The throughput of the mined material may be at least 100, 250, 500 or 1000 tonnes per hour.

The method may also comprise subsequent processing the treated fragments, such as milling, further hydrometallurgical processing and leaching.

The invention will be more fully understood from the following description of specific embodiments of the invention. The description is provided with reference to the accompanying drawings.

BRIEF DESCRIPTION OF THE DRAWINGS

FIG. 5(*b*) is schematic representation of a component of an apparatus for treatment of mined material in accordance with an embodiment of the present invention;

DETAILED DESCRIPTION OF SPECIFIC EMBODIMENTS

Figure 1:
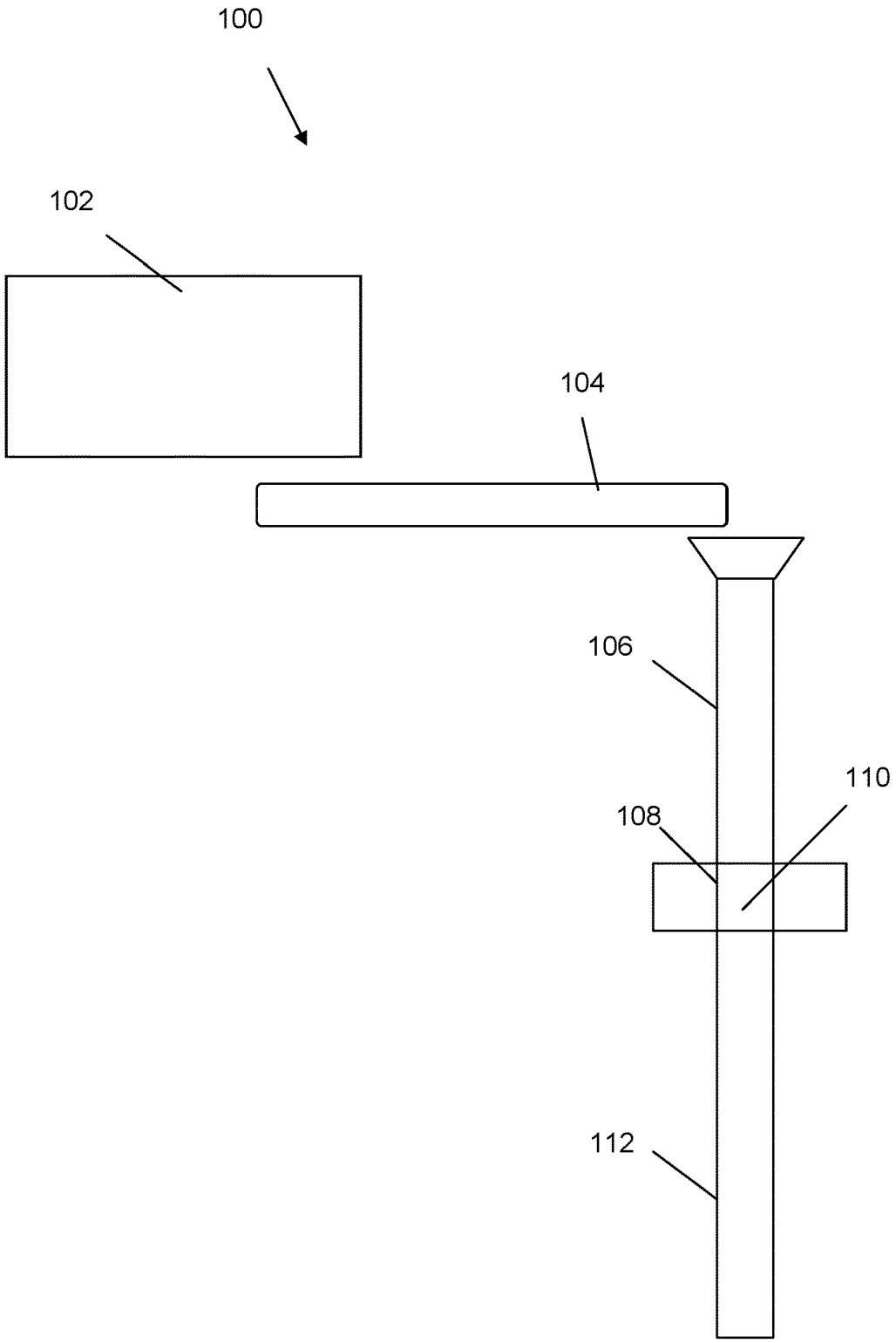
FIG. 1 is a schematic representation of an apparatus for treatment of mined material in accordance with a specific embodiment of the present invention.

Referring initially to FIG. 1, an apparatus for treatment of mined material in accordance with a specific embodiment of the present invention is now described. The apparatus 100 comprises a crusher 102 that is arranged to receive mined material. The mined material may comprise an ore, such as a copper, nickel or iron containing ore or another suitable ore. The crusher 102 is in this embodiment arranged to crush the mined material such that fragments of the mined material have a P80 size of the order of 10 to 75 mm.

The fragments of the mined material are then directed by conveyor belt 104 into a chute that comprises chute portions 106, 108 and 112. The chute provides a vertical passage through which the fragments of the mined material fall by gravity in the form of a packed bed. The chute portion 106 is a conduit that surrounds the falling fragments of the mined material and the chute portion 108 guides the fragments of the mined material through a microwave inlet region 110. The apparatus 100 comprises a microwave generator (not shown) that is arranged to generate high-intensity microwave radiation. The microwave inlet region 110 is positioned such that the fragments that flow in the form of a packed bed are exposed to the microwave radiation. The chute portion 112 directs the fragments of the mined material to an area for further processing.

The microwave generator generates microwave radiation which by interaction with the fragments of the mined material (such as an ore) induces the microwave absorbing phase such that a resulting power-density in the microwave absorbent phase of the ore is in the region of $10^6$-$10^{14}$ W/m$^3$. Different types of materials have different receptiveness for microwave radiation (depending on their dielectric properties) and different thermal expansion coefficients. For example, minerals, silicates or similar that form rock have a thermal expansion coefficient that is different to that of copper or iron containing minerals and also absorb different amount of energy when exposed to the microwaves. Consequently, when for example copper-containing minerals are surrounded by gangue and are exposed to such treatment, micro cracks form due to the differential expansion between the hot mineral and the cold gangue. The micro-cracks form around the boundaries of the hot mineral phase enclosed in the gangue, which facilitates material separation.

The effectiveness of the microwave treatment in inducing micro-cracks depends on the value and rate of development of a temperature differential that is created within the fragments of the mined material during the exposure of the fragments to the microwave radiation. Consequently, preheating of the fragments at a position before the treatment region of the chute portion 108 results in a lower temperature differential and consequently in lower effectiveness of the microwave treatment process.

Embodiments of the present invention provide a microwave applicator and confining chokes. The confining chokes are arranged to restrict via reflection the propagation of the electromagnetic radiation from the microwave inlet region 110 into a passage within the chute portion 106 and thereby attenuate the propagation further into the chute portion 106 by −15 dB, −30 dB or more such that a large percentage of the radiation power is confined over a set distance within the treatment region. The confining chokes are effective to provide an abrupt change in electric field intensity of the electromagnetic radiation as fragments of the mined materials (ores) move through the chokes into the microwave inlet region 110. The highly localised increase in temperature due to the abrupt change in electrical field intensity results in uneven thermal expansion that in turn provides a higher degree of fracture. A further benefit of the confining chokes is that the loss of energy through the chute portion 106 is reduced, which increases the energy available in the treatment region and consequently further increases the efficiency.

Consequently, the chute portion 106 comprises a reflective structure (the above-mentioned choke) that is arranged to reflect a portion of microwave radiation that propagates from the treatment region within and immediately adjacent the microwave inlet region 110 into the chute portion 106. The back reflection of the microwave radiation reduces propagation of the microwave radiation through the chute portion 106. The reflective structure of the chute portion 106 is arranged such that the electric field intensity decreases at a rate of 15 dB/m (typically at least 20 or 30 dB/m) in a direction from the microwave inlet region 110 into the chute portion 106. The fragments of the mined material experience a corresponding increase in electric field intensity at a rate of at least 15 dB/m, typically at least 20 or 30 dB/m (the increase in power density may be of at least 30 dB, 40 or 60 dB within the heated microwave absorbent phase of the fragments dependent on the ore) to cause structural alternations of the fragments of the mined material. Consequently, the volume of the ore that is exposed to high power microwaves is reduced resulting in an increase in power density inside the exposed ore body.

The microwave inlet region 110 is defined by a chute portion that has a microwave inlet through which the generated microwave radiation is directed into the microwave inlet region such that the falling packed bed of the fragments of the mined material are exposed to the generated microwave radiation. The chute 106 comprises in this embodiment an inner conduit or liner that is surrounded by the reflective structure and is arranged to guide the packed bed of the fragments of the mined material through the reflective structure to the microwave inlet region 110. The inner conduit or liner comprises a material that is transparent for the microwave radiation such that the microwave radiation can be reflected by the surrounding chokes. The chute portion 108 guides the packed bed of the fragments of the mined material through the microwave inlet region 110 and has a window that is transparent for the microwave radiation such that the microwave radiation can within the microwave inlet region 110 be directed to the falling packed bed of the fragments of the mined material. Alternatively, the entire inner conduit may be composed of the microwave transmissive material. The reflective structure and the chute portions will be discussed further below in more detail.

The microwave transparent material has selected dielectric properties. A dielectric material has a relative dielectric permittivity $\varepsilon^*=\varepsilon'-j\varepsilon''$ that has a real part $\varepsilon'$ and an imaginary part $j(\varepsilon'')$. A suitable microwave transmissive material has a relative dielectric permittivity that has a real part $\varepsilon''$ in the range of 0.5-50, 1-20 or 5-10 and an imaginary part $\varepsilon''$ ("the dielectric loss factor") in the range of 0.0001-0.1. For example, the microwave transparent material may be $Al_2O_3$, ALN, ALB, quartz or another suitable dielectric material.

In general, the inner conduit (or inner liner) provides an inner surface that does not have any pockets, undulations or recesses in which falling fragments of the mined material may accumulate (and consequently the particles of the mined material experience a "smooth" surface).

The microwave radiation to which the mined material is exposed in the apparatus 100 is continuous (but may in a variation of the described embodiment also be pulsed) and the apparatus 100 is arranged such that the exposure time of the falling packed bed is 0.05 to 1 second. The power density is of the order of $1\times10^7$ W/m$^3$-$1\times10^{13}$ W/m$^3$ in the heated phase within the ore.

Figure 2:
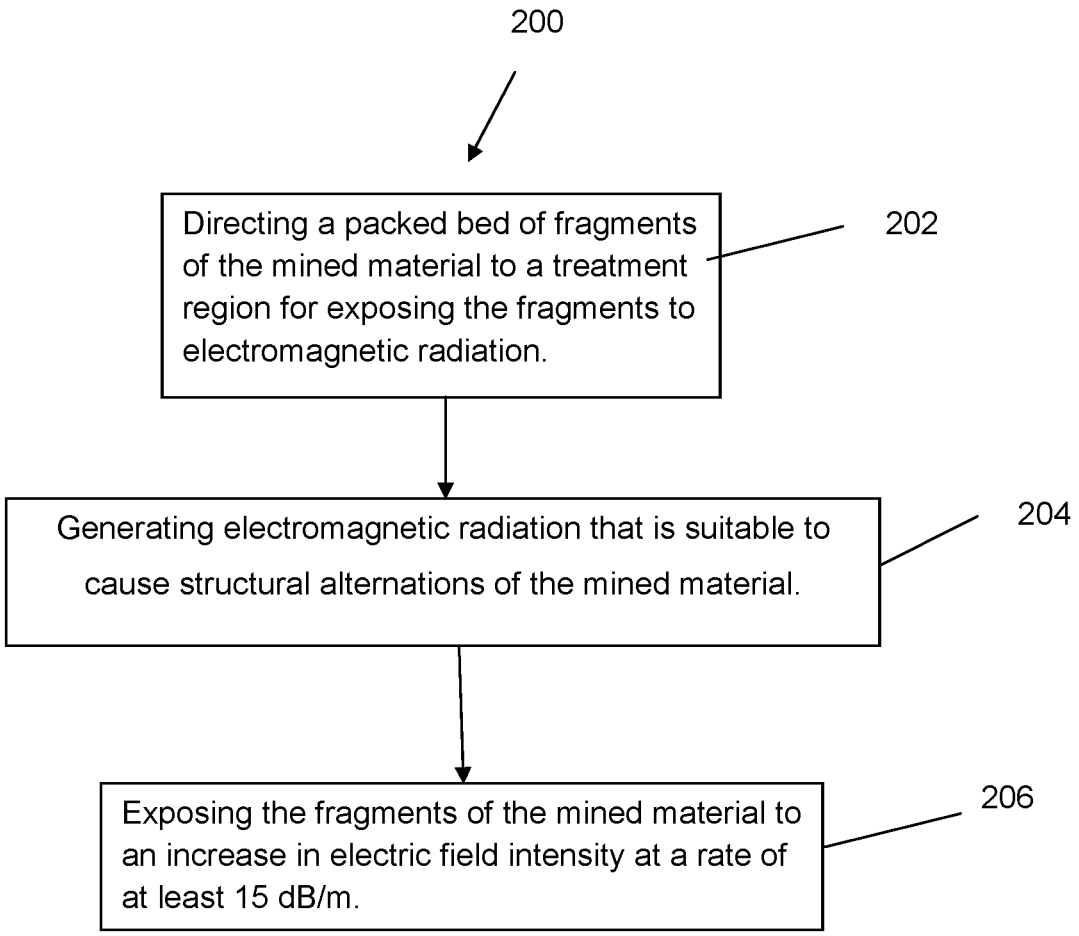
FIG. 2 is a flow chart of a method of treating a mined material in accordance with a specific embodiment of the present invention.

FIG. 2 illustrates a method 200 of treating mined material using the apparatus 100. Step 202 directs the packed bed of the fragments of the mined material to a treatment region for exposing the fragments to the electromagnetic radiation. Step 204 generates electromagnetic radiation that is suitable to cause structural alterations of the mined material. Step 206 exposes the fragments of the mined material to an increase in electric field intensity (and consequently to an increase of power density) along the path through the apparatus at the above-mentioned rate and then to a substantially high intensity electric field to cause structural alternations of the fragments of the mined material.

Figure 3:
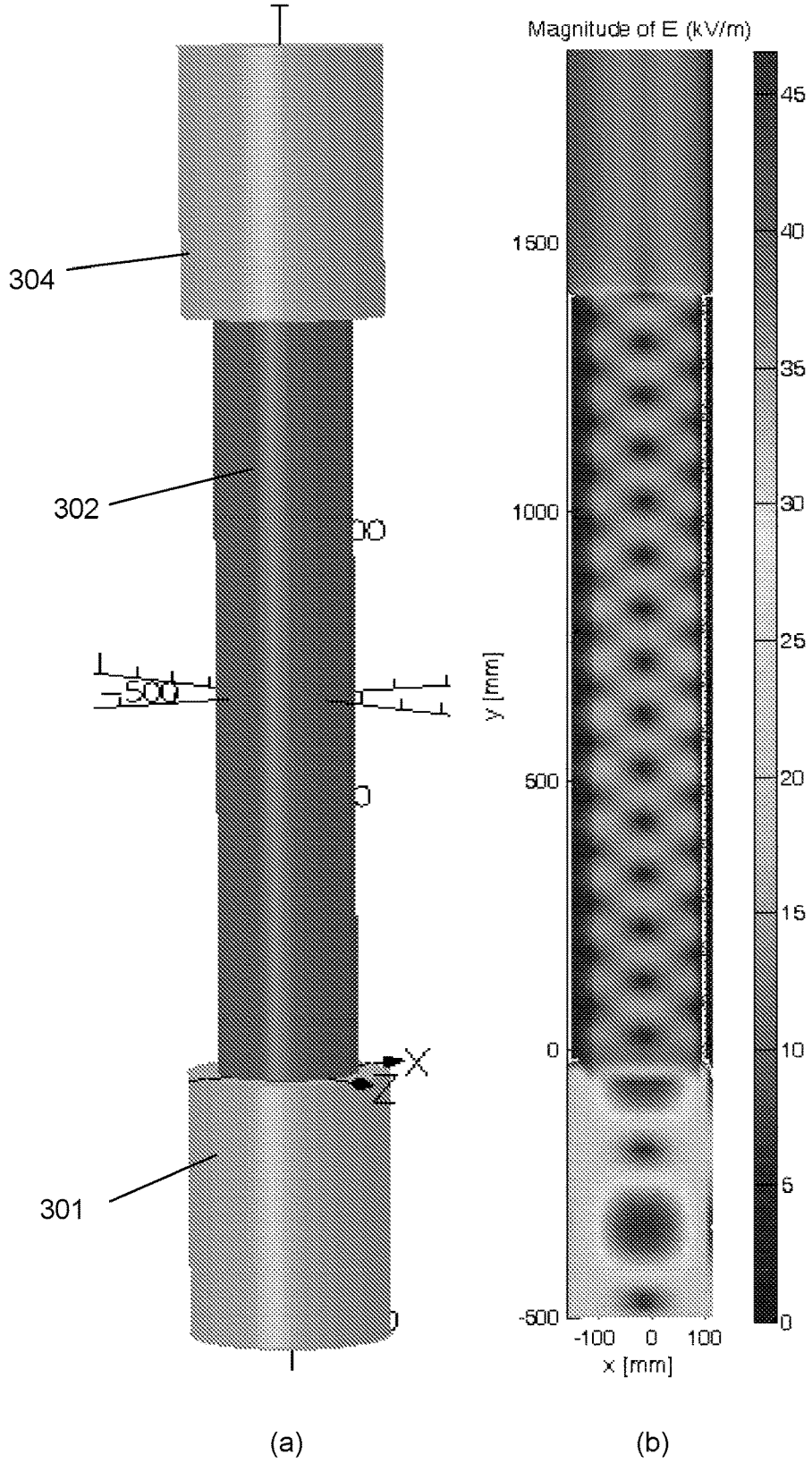
FIG. 3 shows (a) a conduit and (b) a calculated microwave field distribution in a conduit.

FIG. 3(*a*) illustrates a chute portion that comprises a microwave radiation source 301 and a load 304. FIG. 3(*b*) illustrates a corresponding calculated microwave field distribution. The generated microwaves propagate through a tubular section 302 to the load 304. The microwave source 301 and the load 304 have in this example an inner diameter of 300 mm and the tubular section 302 has an inner diameter of 200 mm. For simulation purposes the tubular section 302 has an inner liner that has a dielectric constant of approximately $\varepsilon^*=9-j0$. The chute portions are assumed to be filled with a packed bed of ore having dielectric constant of $\varepsilon^*=4-j0$ (both the alumina liner and ore are taken as loss-less only for the purposes of the simulation). The assumed microwave frequency is 915 MHz.

FIG. 3(*b*) is a simulation of the microwave field distribution and illustrates that the microwaves propagate through portion 302. Consequently, if a chute portion similar to portion 302 would be used for the apparatus 100 to replace the chute portion 106 above the microwave inlet region 110, a portion of the microwave radiation that is directed into the microwave inlet region 110 would propagate through the chute portion and expose the fragments of the mined material to heat treatment prior to the microwave treatment in the treatment region of the portion 108, which would reduce formation of micro-cracks that could be achieved with the microwave treatment.

Figure 4A:
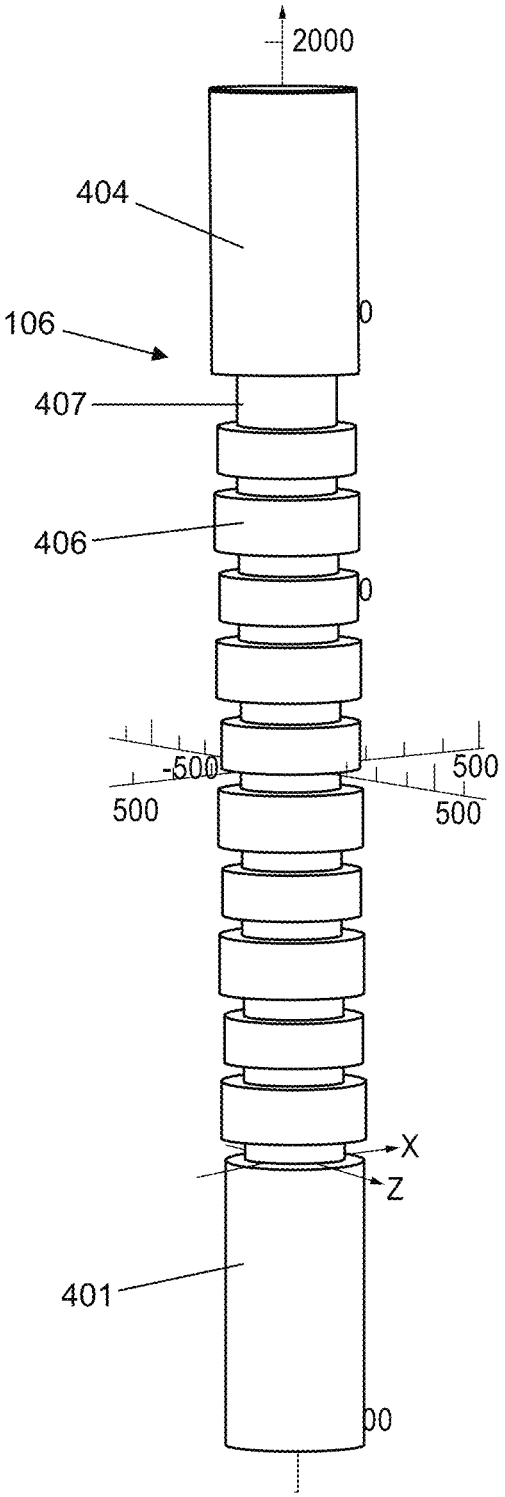
FIG. 4 shows (a) a conduit and (b) a calculated microwave field distribution in a conduit in accordance with a specific embodiment of the present invention.
Figure 4B:
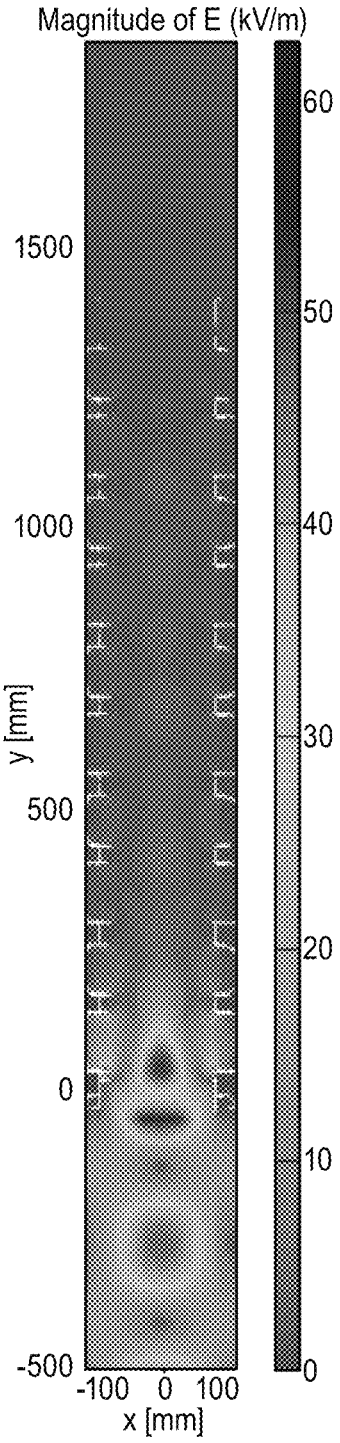

FIG. 4(*a*) shows a chute portion in accordance with an embodiment of the present invention. Specifically, the chute portion 106 above the microwave inlet region 110 of the apparatus 100 illustrated in FIG. 1 is described further detail. For simulation purposes the chute portion 106 is positioned between a microwave source 401 and a load 404.

FIG. 4(*b*) illustrates the corresponding calculated microwave field distribution. As can be seen from FIG. 4(*b*), the propagation of the microwaves into the conduit 106 is greatly reduced, resulting in the above-mentioned increase in electrical field intensity (and consequently power density) and the above-mentioned significant rate, which reduces heating of the mined material before it reaches the treatment region in which the microwave radiation intensity is sufficiently high such that micro cracks are formed in the fragments of the mined material.

In this embodiment, the chute 106 comprises a succession of corrugations 406 that form a metallic tube having a wall profile that undulates in a direction along the tube. The chute portion further comprises an outer metallic shell that is not shown in FIG. 4(*a*). The corrugations 406 are circular and together form a corrugated choke that reflects microwave radiation back into the treatment region of the apparatus 100. In this embodiment, the chute portion 106 comprises 10 of such corrugations, but may alternatively also comprise any other number of corrugations.

The chute portion 106 has an inner liner 407 that is transparent for the microwave radiation and has the above-defined dielectric properties. In this embodiment, the inner liner 407 is composed of a suitable ceramics material or alumina. If heating of the inner liner 407 is unlikely, the inner liner may also be composed of a suitable plastics material. The inner liner 407 has an inner diameter of 200 mm. The inner liner 407 has a wall thickness that is selected such that back reflection of microwaves into the microwave generator is reduced. For the purpose of a simulation of the source 401 and the load 404 are assumed to have an inner diameter of 300 mm. The conduit 106 has a total length of 1200 mm. It will be appreciated that the corrugated choke may alternatively also be provided in another suitable form. For example, the circular corrugations may be replaced by arc-like portions.

It was again assumed for purposes that of the microwave filed distribution that the inner liner 407 has dielectric properties of $\varepsilon^*=9-j0$ and the chute portions are filled with ore having dielectric properties of $\varepsilon^*=4-j0$.

In the embodiment illustrated in FIG. 4(*a*), the protruding sections of the corrugations 406 have dimensions that are of the order of quarter of the group wavelength of the microwaves that are reflected, but not necessarily equal to the latter. Not all corrugations 406 have the same thickness. Consequently the corrugated structure of the chute portion 106 exhibits band-stop characteristics over a wide range of frequencies. The periods of the corrugated structure of the chute portion 106 are chosen such that the corrugated structure reflects the microwave radiation within a band that includes the wavelength of the microwave that is directed to the fragments of the mined material within the microwave inlet region 110 and also minimises the possibility of microwave energy escaping via a fringing field mechanism.

Figure 5A:
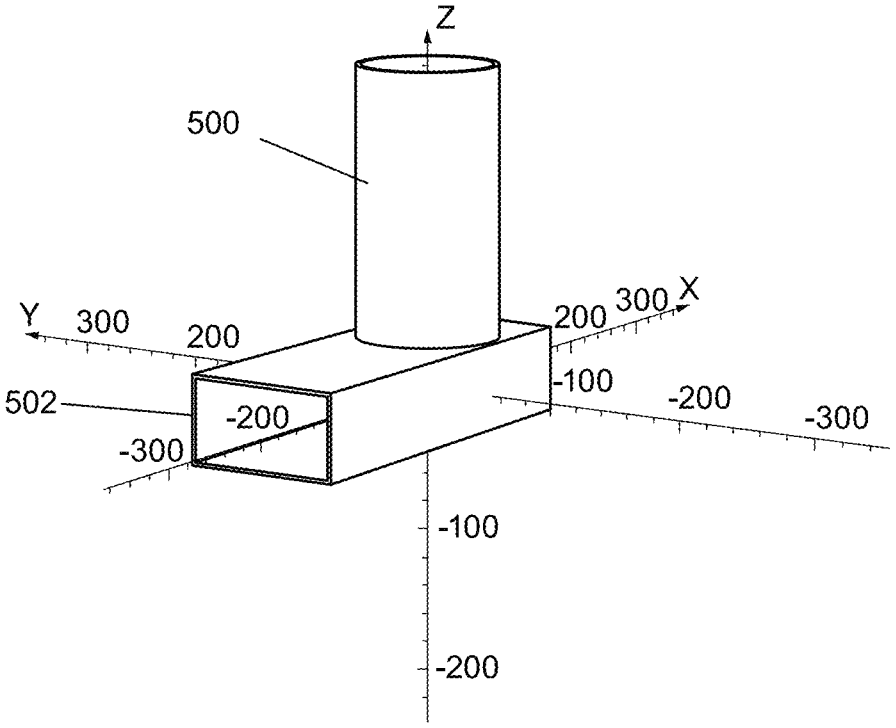
FIG. 5(*a*) is a schematic representation of component including a microwave inlet.
Figure 5B:
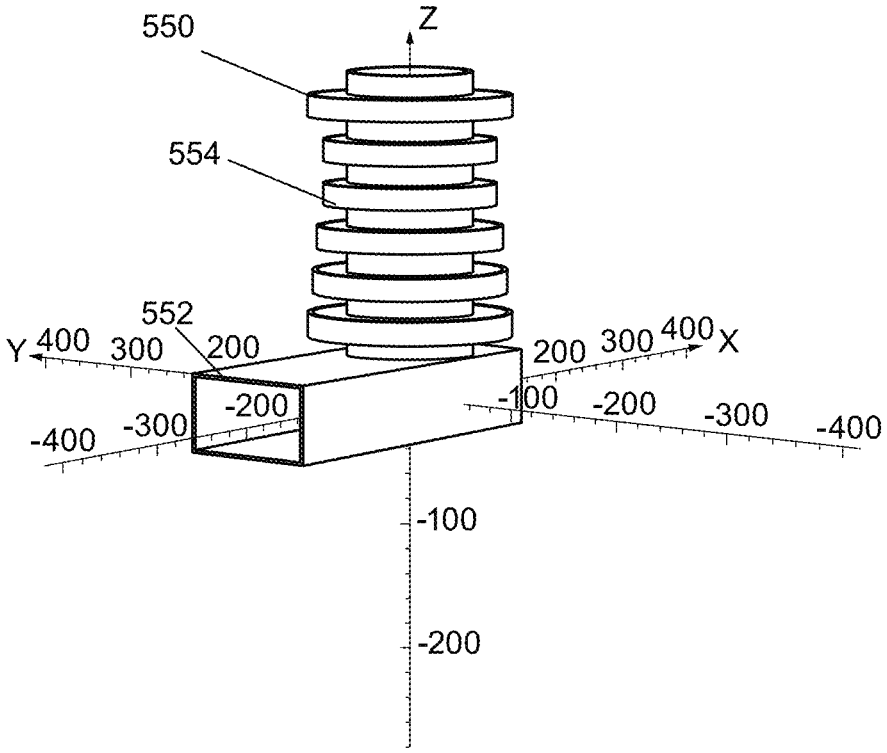

Referring now to FIG. 5(*a*), a further example of a chute portion 500 and a microwave inlet region defined by a microwave inlet 502 is schematically illustrated. FIG. 5(*b*) shows a chute portion 550 and inlet region defined by a microwave inlet portion 552 in accordance with a specific embodiment of the present invention.

Similar to the chute portion 106, the chute portion 550 also comprises a plurality of circular corrugations 554 that together form a corrugated choke and reflect microwave radiation back into the applicator 552. In this embodiment, the chute portion 550 comprises six of such corrugations, but may alternatively also comprise any other number of corrugations. The corrugated choke of the chute portion 550 is a tubular arrangement that is formed form a metallic material and has a largely uniform wall thickness and an undulating inner and outer diameter. A cylindrical liner formed form a material that is substantially transparent for the microwave radiation (such as glass, plastics, or ceramics) is positioned within the corrugated choke. Further, the cute portion 550 has an outer metallic shell that is not shown.

In contrast to the chute portion 106, the corrugations 554 of the chute portion 550 have a diameter that changes along the chute portion 550.

Figure 6A:
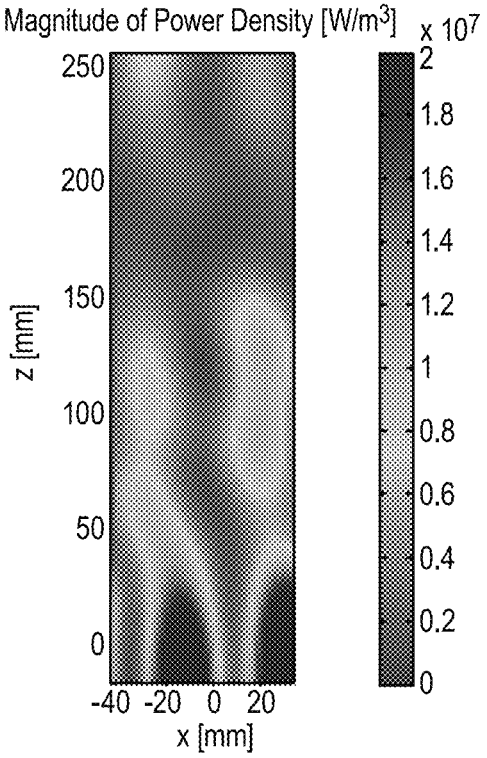
FIGS. 6(*a*) and (*b*) show calculated power density for the components shown in FIGS. 5(*a*) and (*b*), respectively.
Figure 6B:
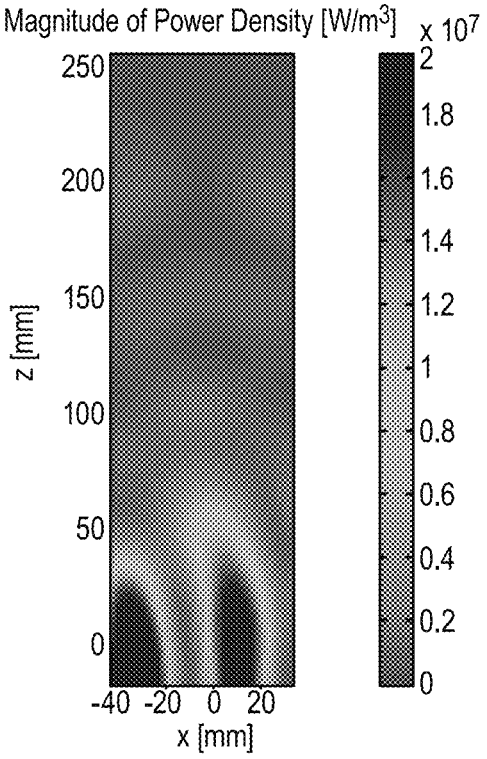

FIGS. 6(*a*) and 6(*b*) illustrate calculated power density distributions that correspond to chute portions 500 and 550 as shown in FIGS. 5(*a*) and 5(*b*), respectively. For the calculation the chute portions 500 and 550 are assumed to have an inner diameter of 100 mm and the microwaves are assumed to have a frequency of 915 MHz. The chute portions are assumed to be filled with a material having an average dielectric constant equal to 3 and a dielectric loss factor equal to 0.1. As can be seen from FIG. 6(*b*), the propagation of the microwaves into the conduit 550 is greatly reduced, which reduces heating of the mined material before it reaches the treatment region. As can be seen from FIG. 6(*a*) for the cute portion 500, the electric field reaches far into the chute portion 500.

Figure 7:
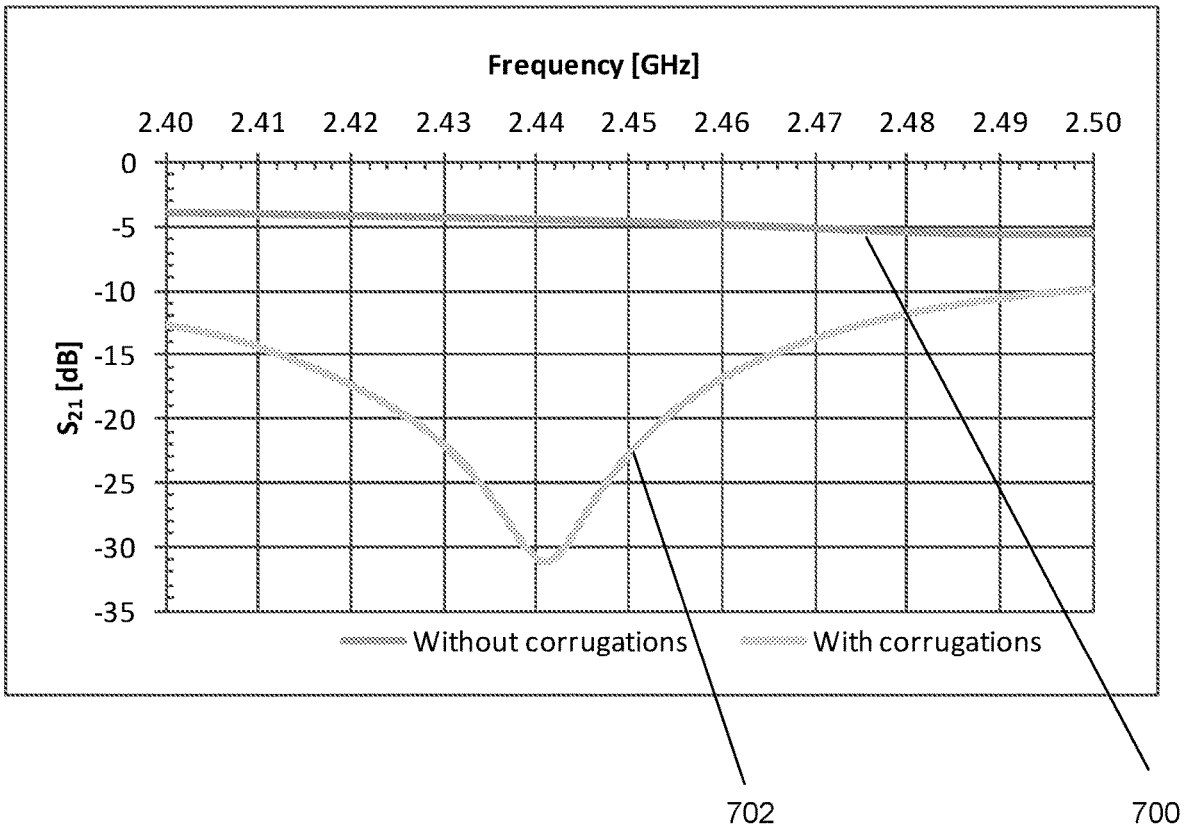
FIG. 7 shows plots of microwave scattering parameters as a function of microwave frequency for the components shown in FIGS. 5*a* and 5*b*, respectively.

FIG. 7 shows calculated plots of attenuation as a function of microwave frequency for the chute portion 500 and 550 illustrated above with reference to FIGS. 5*a* and 5*b*. Plot 700 corresponds to the calculated attenuation of the chute portion 500 and plot 702 corresponds to the calculated attenuation of the chute portion 550. The attenuation of the microwaves does not change significantly with frequency for the chute portion 500 whereas the attenuation of the microwaves is strongly reduced within the range of approximately 2.42 and 2.48 GHz. At a frequency of 2.45 GHz the attenuation is approximately −4 dB for the chute portion 500 and approximately −23 dB for the chute portion 550. However, it will be appreciated that this is an example only and other much lower frequencies are envisaged, such as frequencies in the range of 300-400 MHz, such as 350 MHz, which would allow suitable standing wave generation of the microwaves in chutes having a much larger diameter suitable for higher throughput.

Figure 8A:
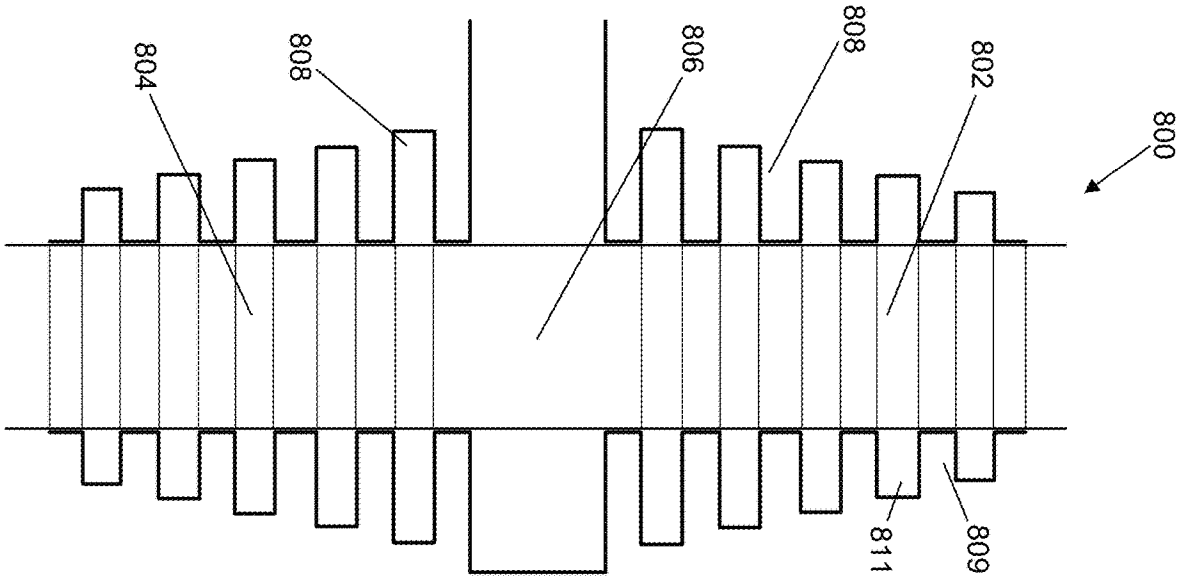
FIG. 8 shows (a) a schematic representation of a component of an apparatus in accordance with within an embodiment of the present invention and (b) a plot illustrating a power distribution though the apparatus.
Figure 8B:
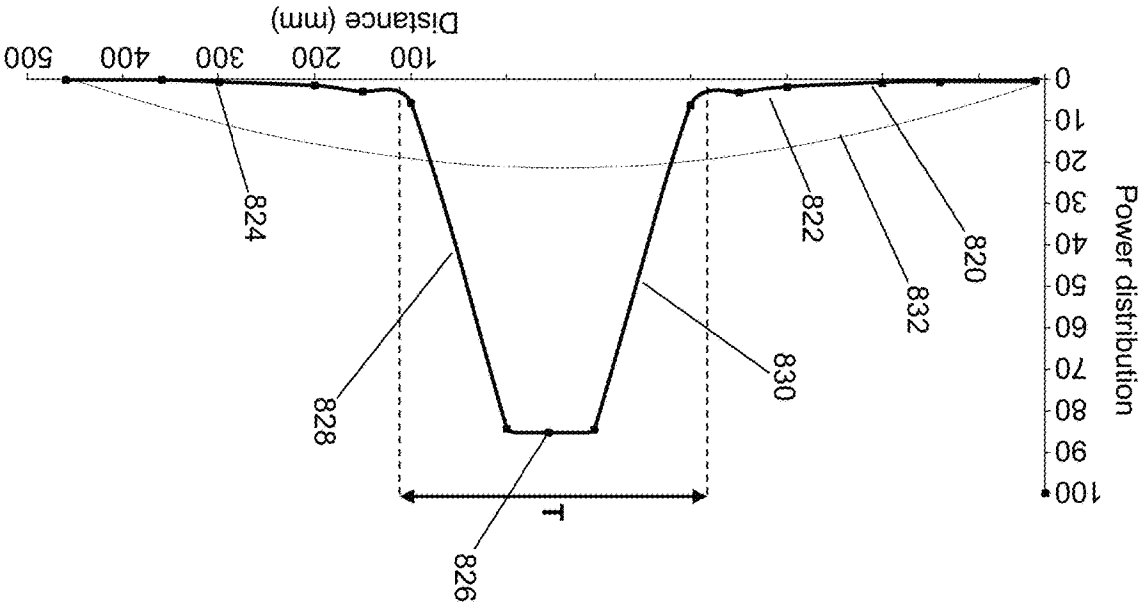

FIG. 8(*a*) is a schematic cross-sectional representation of a component (microwave applicator) 800 of an apparatus for treatment of mined material in accordance with an embodiment of the present invention. The component 800 comprises conduits 802 and 804 (corresponding to conduits 106 and 112 shown in FIG. 1) and a microwave inlet region 806 that is positioned between the conduits 802 and 804. The microwave inlet region 806 is arranged to receive microwave radiation generated by a suitable source (not shown). The conduits 802 and 804 comprise the above-mentioned reflective structure having corrugations 808. In this embodiment the conduits 802 and 804 comprise identical reflective structures that are oriented inversely relative to each other and microwave inlet region 806 is sandwiched between the conduits 802 and 804 with the reflective structures. The corrugations 808 are formed form a metallic material and comprise solid metallic rings 809 that are separated by ring-like regions 811 of a dielectric material. In this embodiment the ring-like regions 811 are filled with a material that is transparent for the microwave radiation, (and that has the above-described dielectric properties) such that the conduits 802 and 804 have a uniform inner diameter.

The corrugations 808 of the reflective structures 802 and 804 decrease in diameter in a direction away from the microwave inlet region 806. The component 800 is arranged such that the microwave absorbent phase of the fragments of mined material that are directed through the conduit 802 to the microwave inlet region experience an increase in power density (dependent on the type of the ore) at a rate of at least 30, 40 or 60 dB/m or more. This significant increase in power density over a relatively short distance is schematically indicated in plot 820 shown in FIG. 8(*b*) (assuming a homogeneous density distribution of fragments of the mined material). The plot 820 has substantially flat portions 822, 824 and 826 and step portions 828 and 830. The step portions 828 and 830 together with the flat portion 826 define a treatment region T within which the fragments of the mined materials are exposed to the microwave radiation. As can be seen by comparing FIGS. 8(*a*) and 8(*b*) with each other, the treatment region T extends into conduits 802 and 804 beyond the microwave inlet region 806. Each corrugation 808 of the reflective structures has a diameter that is calculated to stop the propagating mode at specific frequencies under specific conditions (such as packing density and permittivity).

Also shown in FIG. 8(*b*) is a schematic illustration 832 of a power distribution that the component 800 would have if the conduits 802 and 804 would not comprise the discussed reflective structures. The plot 832 is relatively flat and does not include regions in which the fragments of the mined material would experience a sudden increase in power density and consequently an effectiveness of the microwave treatment would be relatively low.

Figure 9:
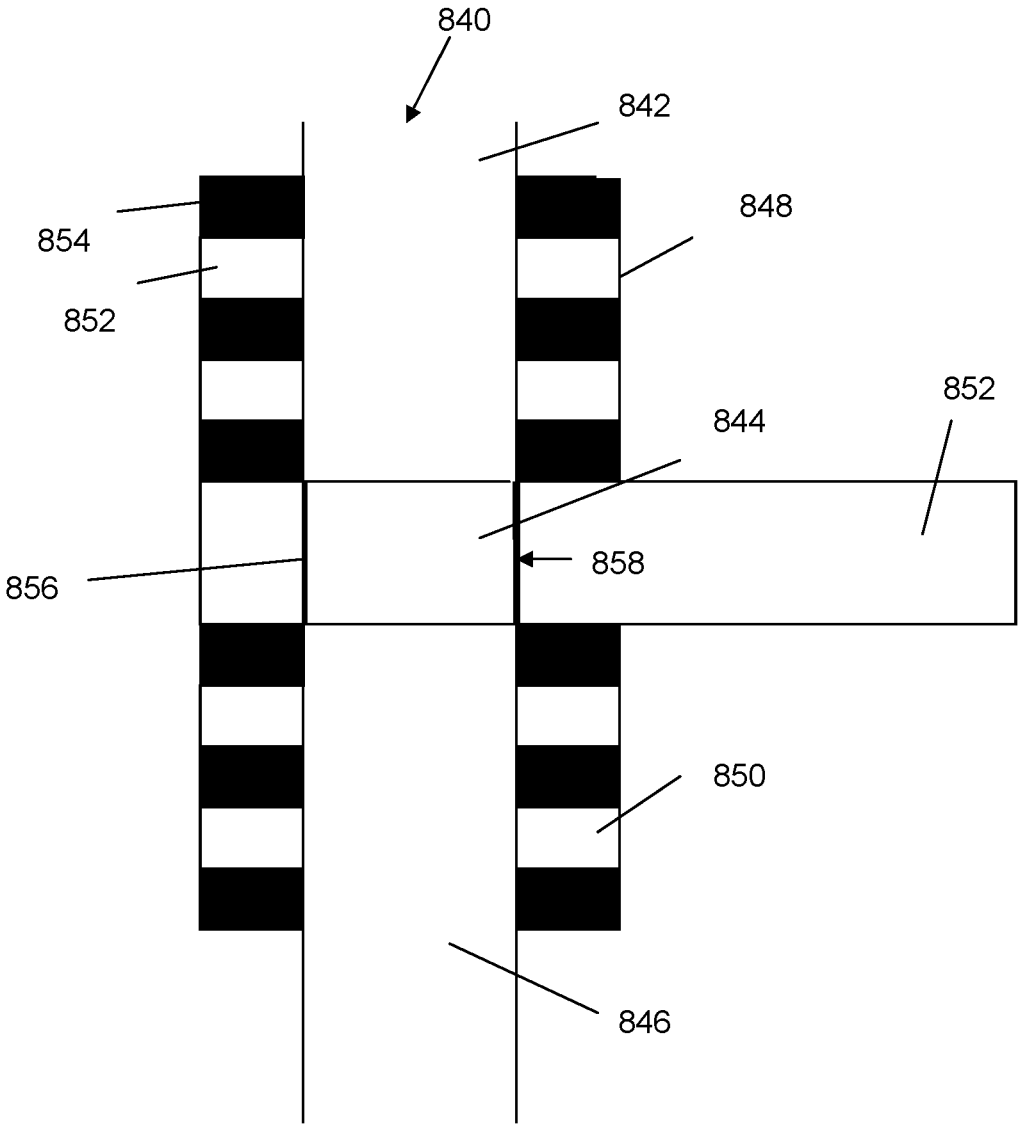
FIGS. 9 and 10 show a schematic representation of a component of an apparatus in accordance with within embodiments of the present invention.

FIG. 9 is a schematic cross-sectional representation of an apparatus 840 in accordance with a further embodiment of the present invention. The apparatus 840 comprises chute portions 842, 844 and 846. These chute portions have the same interior diameter such that throughput of a packed bed of the fragments of the mined material by gravity is facilitated. The apparatus 840 comprises reflective structures 848 and 850. The reflective structures 848 and 850 are similar to the reflective structures of the conduits 802 and 804 illustrated above with reference to FIG. 8. In this embodiment the reflective structures 848 and 850 comprise solid metallic rings 852 that are separated by rings 854 that also include a dielectric material. The reflective structures 848 and 850 are arranged such that a succession of the portions 852 and 854 results in an undulating dielectric environment as experienced by microwave radiation which is arranged such that the reflective structures 848 and 850 produce penetration of microwave radiation into the conduits 842 and 846 in the above described manner. The microwave radiation is directed to the falling packed bed of the fragments of the mined material in microwave inlet region 852. The chute portion 844 comprises metallic wall portions, but has a window 858 that is composed of a material that is transparent for the microwave radiation (and has the above-described dielectric properties) such that the microwave radiation can be directed into the chute portion 844 for treatment of the fragments of the mined material during free-fall of the packed bed.

Alternatively, the entire chute portion 844 may be composed of a material that is transparent for the microwave radiation. Further, in a variation of the described embodiment the reflective structures 842 and 846 may comprise an inner liner (such as a tube) that is composed of a material that is transparent for the microwave radiation.

Figure 10:
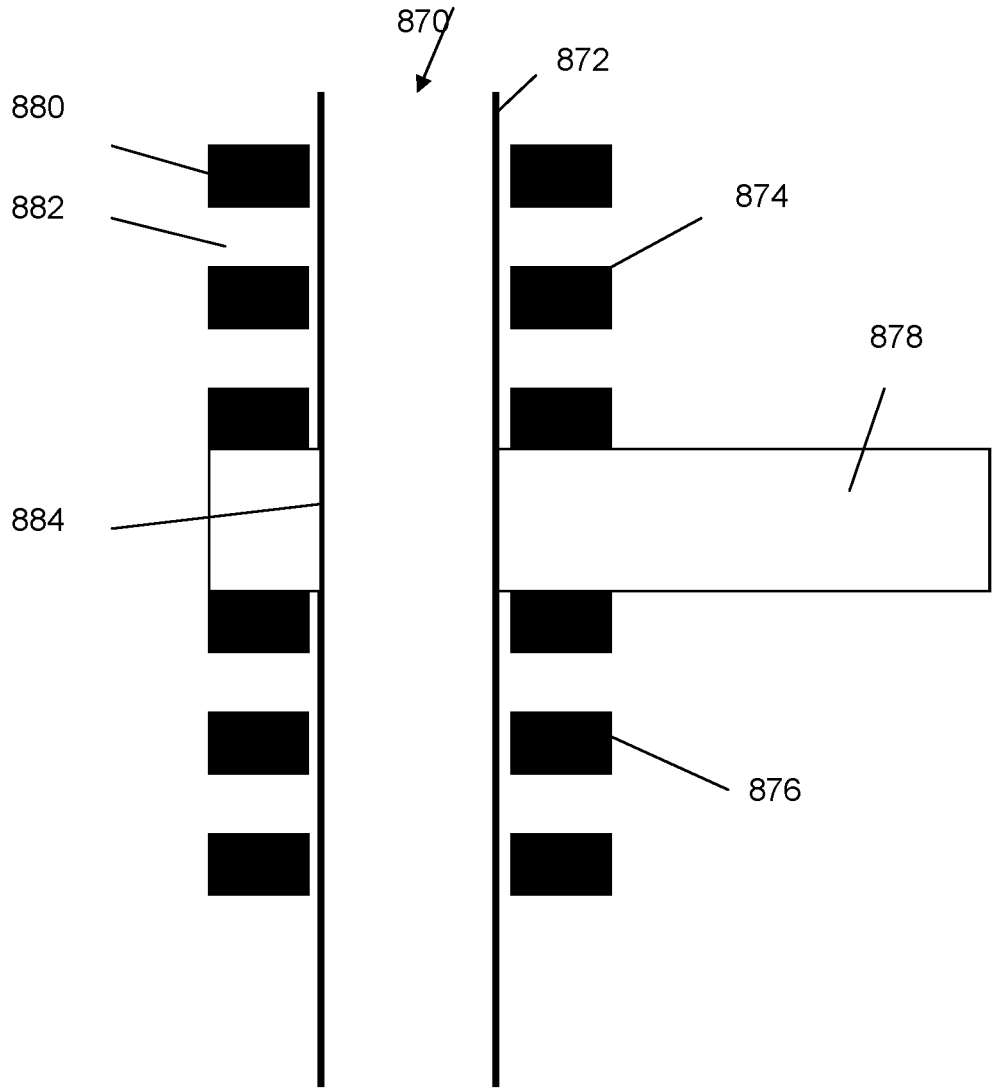

FIG. 10 is a cross-sectional schematic representation of an apparatus for treatment of mined material in accordance with a further embodiment of a present invention. The apparatus 870 comprises a conduit 872 for throughput of a packed bed of the fragments of the mined material. The apparatus 870 further comprises reflective structures 874 and 876 that are positioned above and below, respectively, a microwave inlet region 878. The reflective structures 874 and 876 comprise a succession of metallic rings 880 and rings that also comprise dielectric materials 882. For example, the metallic rings 880 may exclusively be composed of steel and the dielectric portions 882 may comprise steel and a material that is transparent for microwave radiation and may alternatively also comprise air gaps or pockets. The conduit 872 also has wall portions that are formed from a material that is transparent for the microwave radiation.

The conduit 872 is arranged such that the microwave radiation can be directed through a wall portion of the conduit 872 at the microwave inlet region 878. Further, as the conduit 872 comprises a material that is transparent for microwave radiation, the alternating ring like zones 880 and 882 can function in the above-defined manner and reduce a penetration of the microwave radiation into the conduit 872 form the microwave inlet region 878.

It will be appreciated that the reflective structures shown in FIGS. 9 and 10 may comprise any suitable number of metallic and dielectric zones. Further, the metallic and dielectric zones may or may not have the same diameter and, similar to the zones 809 and 811 shown in FIG. 8, may have an exterior diameter that changes in a direction along the throughput of the falling packed bed of the fragments of mined material.

Figure 11:
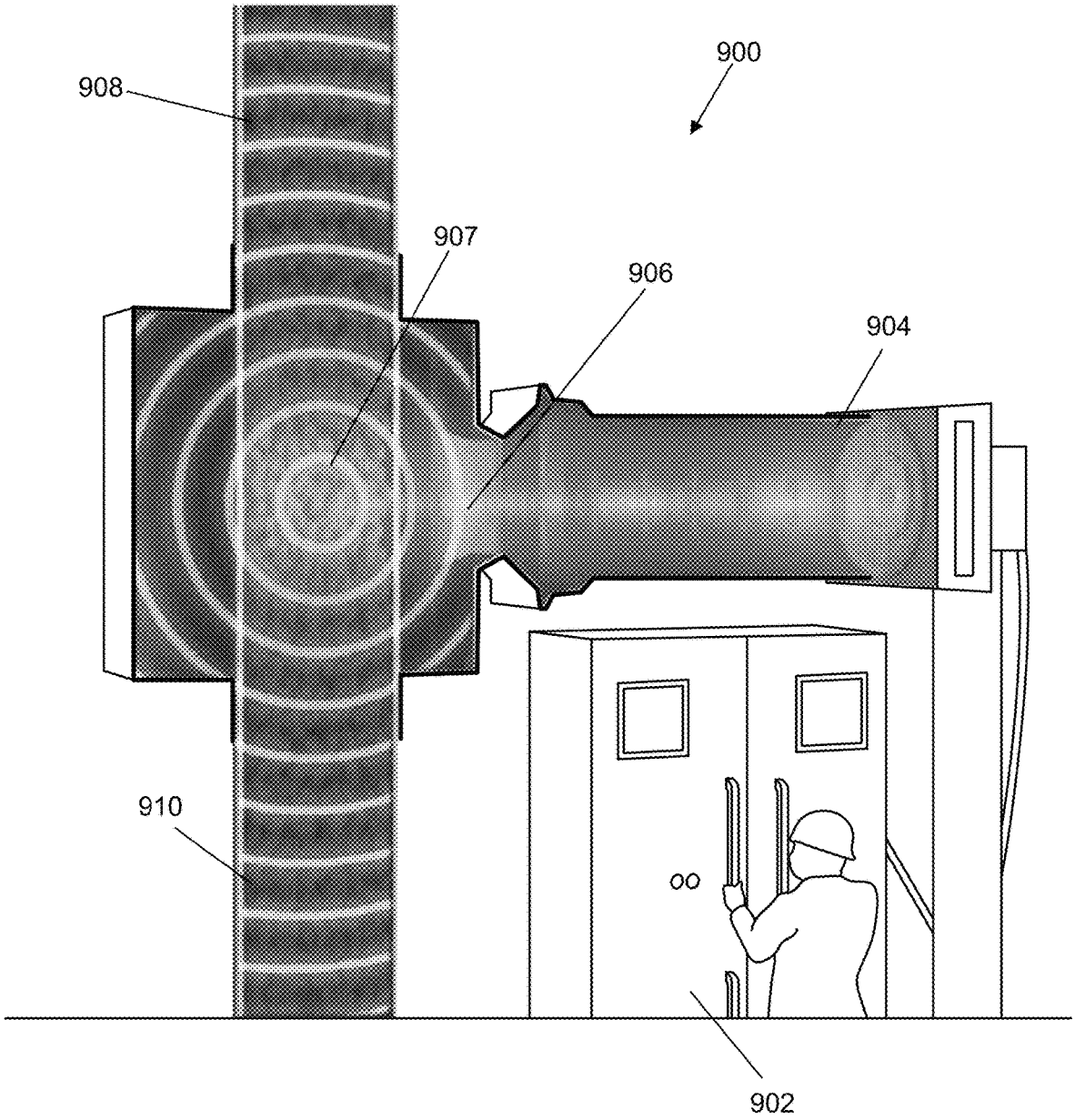
FIGS. 11 and 12 show representations of an apparatus for treatment of mined material.

FIG. 11 shows an apparatus 900 for treatment of mined material. The apparatus 900 comprises a microwave generator 902, a microwave waveguide 904 and a microwave inlet portion 906 defining a microwave inlet region in a chute portion. A conduit 908 directs the mined material through the microwave inlet component 906 into a conduit 910. A spread of microwave radiation from the microwave inlet portion 906 far into the conduits 908 and 910 is illustrated and significant pre-heating of the mined material before the mined material reaches the microwave inlet portion 906 follows as a consequence.

Figure 12:
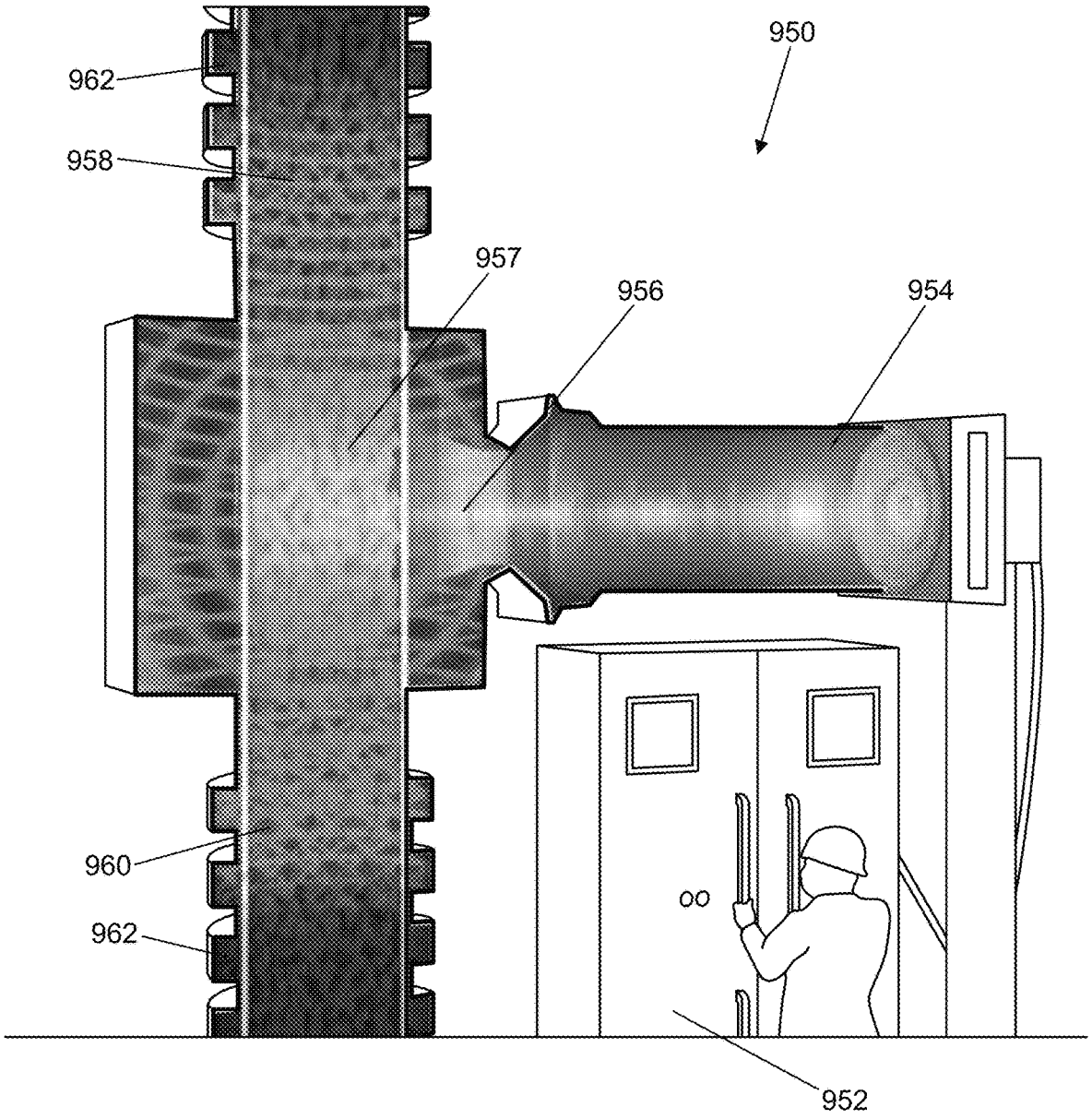

FIG. 12 shows an apparatus for treatment of mined material in accordance with a specific embodiment of the present invention. The apparatus 950 comprises a microwave generator 952, a microwave waveguide 954 and the above-mentioned microwave inlet portion 956 together with the conduits 958 and 960. The conduit 958 directs the mined material through the microwave inlet portion 956 into the conduit 960. The conduit 958 and also the conduit 960 have the corrugated choke structure 962 that was described above. The corrugated choke structure 962 reflects microwave radiation from the conduits 958 and 962 back into the microwave inlet portion 956 and consequently leakage of microwave radiation from the microwave inlet portion 956 into the conduits 958 and 960 can be significantly reduced. The reduction of leakage of microwave radiation into the conduit 958 reduced pre-heating of the mined material and consequently increases the effectiveness of the microwave treatment in the microwave inlet portion. The reduction of leakage into both the conduit 958 and the conduit 960 also has the advantage of enhanced power exposure of the ore in microwave inlet portion.

Figure 13:
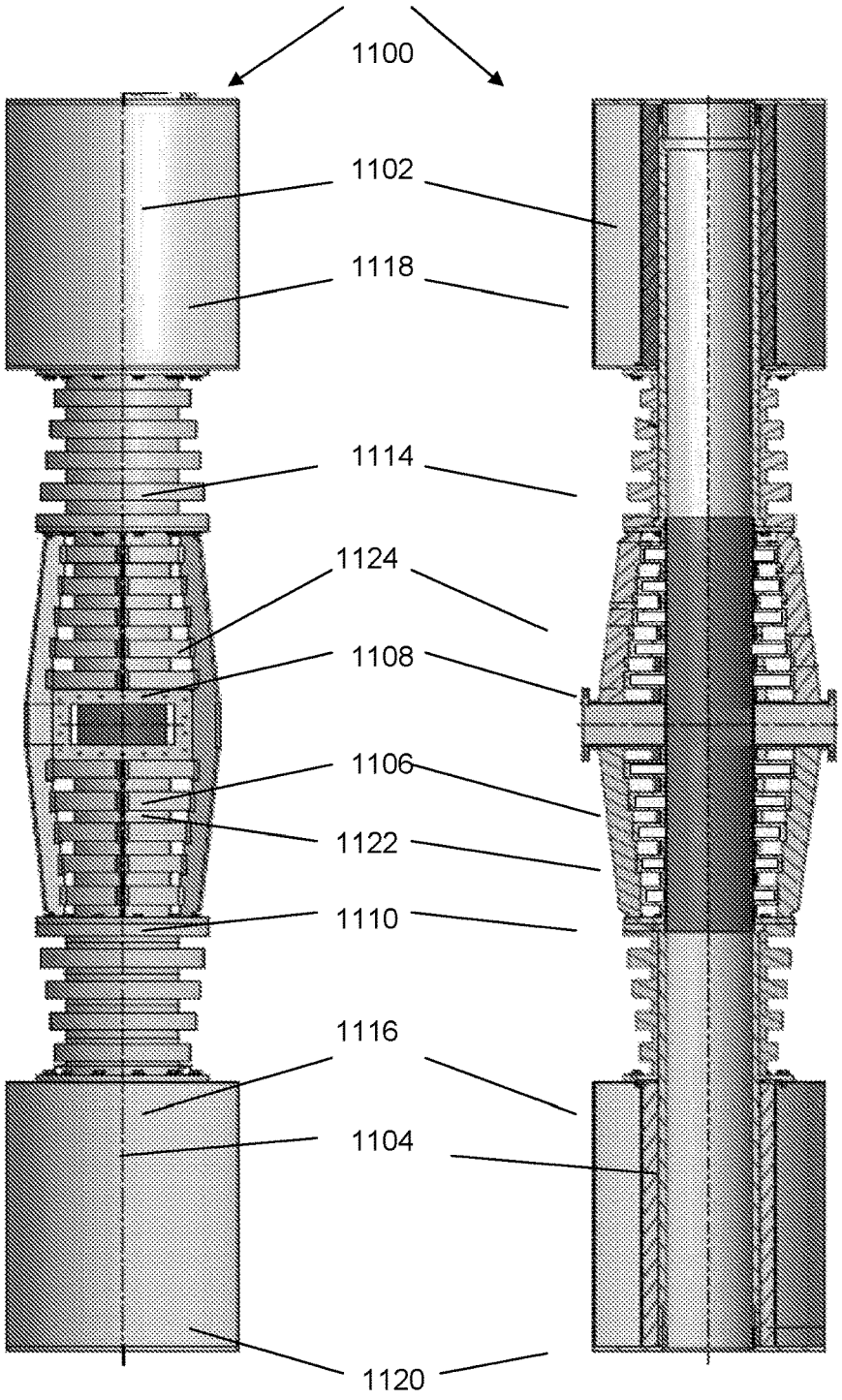
FIGS. 13(*a*) and (*b*) show representations of components of an apparatus for treatment of mined material in accordance with embodiments of the present invention.

FIG. 13 shows (a) a side view and (b) a cross-sectional view of a component 1100 of an apparatus for treatment of mined material in accordance with a specific embodiment of the present invention. The component 1100 comprises conduits 1102 and 1104 which are used to direct the particles of the mined material to and from a microwave radiation treatment region that is mainly located within microwave inlet portion 1106, but slightly extends beyond the microwave inlet portion 1106 into the conduit 1102 and 1104. The conduits 1102 and 1104 have corrugated reflective structures 1108 and 1110 that are arranged to confine the electric field associated with the microwave radiation in a manner such that the fragments experience an increase in electric field at the above-mentioned high rate when passing into the treatment region.

The microwave radiation is generated by a microwave radiation source (not shown) that is coupled to the microwave inlet portion 1106. The conduits 1102 and 1104 comprise further corrugated reflective structures 1114 and 1116, which are arranged to reduce propagation of microwave radiation away from the microwave inlet portion 1106 further. In addition, the conduits 1102 and 1104 have absorbent microwave chokes 1118 and 1120, respectively, which ensure that there is no leakage of microwave radiation out of the component 1100.

The component 1100 also comprises a tube 1122 that is positioned within the microwave inlet portion 1106, the reflective structure 1108 and the reflective structure 1110. The tube 1122 is formed from a material that is transparent to microwave radiation (and which has the above-described dielectric properties). Further, the component 1100 comprises a steel encasing 1124 that encloses a portion of the microwave inlet portion 1106 and the corrugated reflective structures 1108 and 1110.

In this embodiment the reflective corrugated structures 1108 and 1110 have identical properties, but are rotated about a central transversal axis through the microwave inlet portion 1106 by 180°. Consequently, the reflective structure 1108 results in a steep increase in electrical field (or power density) as experienced by the fragments and the reflective structure 1110 results in a steep decrease in electric field intensity (or power density) as experienced by the falling particles.

The reflective structure 1108 increases the efficiency of the microwave treatment by confining the electric field (and power density). Both reflective structures 1108 and 1110 reduce loss of electric field intensity (and power density) from the treatment region to the conduits, which increase the efficiency of the microwave treatment and reduces power consumptions.

Figure 14:
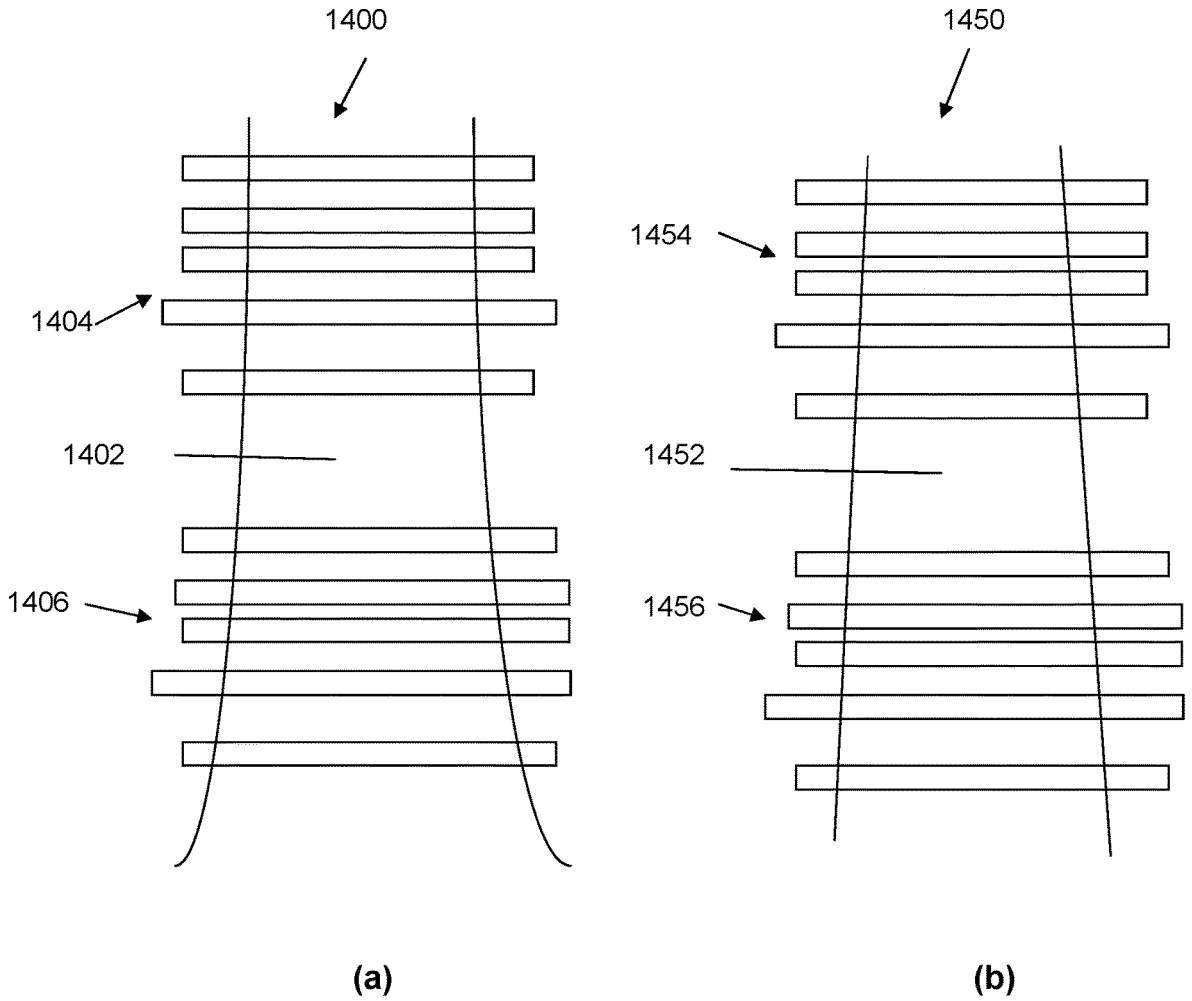
FIG. 14 shows a representation of an apparatus for treatment of mined material in accordance with further embodiments of the present invention.

Referring now to FIG. 14, components of an apparatus in accordance with further embodiments of the present invention are now described. The components 1400 and 1450 are similar to the components shown in FIGS. 8 to 13. The components 1400 and 1450 comprise reflective structures 1404, 1406 and 1454, 1456, respectively. The components 1400 and 1450 also comprise microwave inlet portions 1402 and 1452 respectively that are positioned between the conduits 802 and 804. The microwave inlet portions 1402 and 1452 are arranged to receive microwave radiation generated by a suitable source (not shown). The reflective structures 1404, 1406, 1454, and 1456 comprise zones that result in a reduction of propagation of microwave radiation into conduits form the microwave inlet regions in a manner similar to the zones of the conduits 802, 804 described above with reference to FIG. 8. However, in contrast to the previously described components, the components 1400 and 1450 do not have a uniform inner diameter. The component 1400 has an inner liner that provides a passage that increases progressively in diameter in a downward direction. The component 1450 also has an inner liner that increases in diameter in a downward direction, but in this specific case the inner diameter increases linearly.

It will be appreciated by a person skilled in the art that the components 1400 and 1450 may alternatively be provided in various related forms. For example, the components may comprise sections in which the passage has a substantially uniform diameter and that are adjacent sections in which the diameter changes. Further, the components 1400 and 1450 may not have an inner liner, but the zones of the reflective structure may be arranged to provide the passage that has a diameter that changes in the above-described manner. The extent of the change in the diameter of the passage depends on a number of factors including but not limited to a target throughput for the apparatus, the mineralogy and composition of the mined material, the size of the fragments including the fragment size distribution, the packing density in the bed, the power intensity and other characteristics of the microwave radiation.

It is to be appreciated that various variations of the described embodiments are possible. For example, the apparatus 100 may be arranged to generate microwave radiation having any suitable frequency. Further, the chute portion 106 may not necessarily be arranged vertically and may have any suitable cross-sectional shape, diameter and length. Further, the chute portion 106 may have any number of ring or arc-like zones. In addition, it is to be appreciated that the described apparatus may not necessarily comprise reflective microwave choke structures, but may in a variation of the described embodiments also comprise absorbing microwave choke structures, which may designed such the fragments of the mined material experience an increase of electric filed intensity (and a corresponding increase in power density) at the described high rate.

The invention claimed is:

1. An apparatus for treatment of mined material, the apparatus comprising:

a source for generating electromagnetic radiation;

a radiation inlet;

a radiation inlet region at the radiation inlet and being arranged for exposing fragments of the mined material to the generated electromagnetic radiation;

a tubular circular passage with a smooth surface facing the fragments of the mined material for guiding the fragments of the mined material to the radiation inlet region; and a reflective structure separate from the passage and surrounding at least a portion of the passage, the reflective structure being arranged to attenuate penetration of the electromagnetic radiation from the radiation inlet region into the passage during throughput of the fragments of the mined material, wherein the reflective structure comprises a metallic tube that comprises a plurality of a succession of circular first zones and circular second zones, and wherein the first zones have an average inner diameter that is smaller than that of the second zones and are arranged such that the metallic tube has an inner diameter that undulates in a direction along the tube such that the metallic tube has a corrugated wall portion that produces a reflected electromagnetic radiation towards the radiation inlet region, wherein the reflective structure has a dimensional periodicity of protruding sections of the second zones of the corrugated wall portion which produces reflected electromagnetic radiation that includes the wavelength of the electromagnetic radiation to which the fragments are exposed, and wherein the reflective structure produces an electric field with electric field intensity which increases towards the radiation inlet region at a rate of 15 dB/m or greater.

2. The apparatus of claim 1, wherein the reflective structure is arranged such that the electric field intensity associated with the electromagnetic radiation decreases at a rate of at least 15 dB/m in a direction from the radiation inlet region into the passage.

3. The apparatus of claim 1, wherein the reflective structure comprises an inner conduit that has at least a wall portion formed from a material that is transparent for the electromagnetic radiation and that is positioned to provide the passage.

4. The apparatus of claim 1 wherein the radiation inlet region comprises an inner conduit that comprises at least a wall portion that is formed form a material that is transparent for the electromagnetic radiation and is at least partially positioned at the radiation inlet region.

5. The apparatus of claim 3 wherein the material that is transparent for the electromagnetic radiation has a relative dielectric permittivity $\varepsilon^*\varepsilon'-j\varepsilon''$ ($\varepsilon'$: real part of the relative dielectric permittivity; $\varepsilon''$: imaginary part of the relative dielectric permittivity) and wherein $\varepsilon''$ is less than 0.1.

6. The apparatus of claim 3 wherein the material that is transparent for the electromagnetic radiation has a relative dielectric permittivity $\varepsilon^*\varepsilon'-j\varepsilon''$ ($\varepsilon'$: real part of the relative dielectric permittivity; $\varepsilon''$: imaginary part of the relative dielectric permittivity) and wherein $\varepsilon'$ is in the range of 1–20.

7. The apparatus of claim 1 wherein the reflective structure is positioned superjacent the radiation inlet region.

8. The apparatus of claim 1 wherein the apparatus is arranged for throughput of a packed bed of the fragments of the mined material by gravity.

9. The apparatus of claim 1 wherein the reflective structure is arranged such that an electric field intensity associated with the electromagnetic radiation increases towards the radiation inlet region at a rate of 30 dB/m or greater region into the passage.

10. The apparatus of claim 1 wherein the source is arranged to generate microwave radiation.

11. The apparatus of claim 10 wherein the apparatus is arranged such that the microwave radiation causes heating of the fragments of the mined material in the passage and an associated power-density in at least some heated portions of fragments of the mined material is at least $1\times10^9$ W/cm$^3$ when the fragments of the mined material are put through the apparatus in the form of a packed bed.

12. The apparatus of claim 10 wherein the apparatus is arranged such that the microwave radiation causes heating of the fragments of the mined material in the passage and an associated power-density in at least some heated portions of fragments of the mined material are put through the apparatus in the form of a packed bed.

13. The apparatus of claim 1 wherein a length of the reflective structure is arranged such that microwave radiation propagating along a portion of the length will traverse an environment in which dielectric properties change periodically.

* * * * *